US009725223B2

(12) United States Patent
Chang

(10) Patent No.: US 9,725,223 B2
(45) Date of Patent: Aug. 8, 2017

(54) PACKAGING MATERIAL

(71) Applicant: LI JAW INDUSTRIAL CO., LTD., New Taipei (TW)

(72) Inventor: Kun-Hsiang Chang, New Taipei (TW)

(73) Assignee: LI JAW INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 14/955,661

(22) Filed: Dec. 1, 2015

(65) Prior Publication Data

US 2017/0152096 A1 Jun. 1, 2017

(51) Int. Cl.

| | |
|---|---|
| ***B65D 5/00*** | (2006.01) |
| ***B65D 81/02*** | (2006.01) |
| ***B65D 5/20*** | (2006.01) |
| ***B65D 5/42*** | (2006.01) |

(52) U.S. Cl.

CPC ..... *B65D 81/022* (2013.01); *B65D 5/0035* (2013.01); *B65D 5/20* (2013.01); *B65D 5/2009* (2013.01); *B65D 5/4279* (2013.01)

(58) Field of Classification Search

CPC B65D 77/0433; B65D 5/2009; B65D 5/4279; B65D 5/5054; B65D 5/0035; B65D 5/22; B65D 81/022; B65D 5/20

USPC ..... 229/167, 165, 178, 918, 174, 122.32, 229/172, 177, 186, 919, 190, 143, 154, 229/170, 179, 194, 198.2

See application file for complete search history.

(56) References Cited

U.S. PATENT DOCUMENTS 3,114,493 A * 12/1963 Dunkin ..... B65D 5/0035 206/511
3,940,053 A * 2/1976 Putman ..... B65D 5/003 206/509
5,913,474 A * 6/1999 Chu ..... B65D 5/0035 229/167

FOREIGN PATENT DOCUMENTS

| | | |
|---|---|---|
| TW | 390340 | 5/2000 |
| TW | 516507 | 1/2003 |

* cited by examiner

*Primary Examiner* — Christopher Demeree
(74) *Attorney, Agent, or Firm* — Muncy, Geissler, Olds & Lowe, P.C.

(57) ABSTRACT

A packaging material as a formed integral includes a lower plate, a first side plate connected to a first side of the lower plate, and a second side plate connected to a second side of the lower plate. The first side plate includes a first plate body, a first bending line formed on the first plate body and for connecting the first side, and a first assembly portion disposed at one side of the first plate body. The second side plate includes a second plate body, a second bending line disposed at one side of the second plate body, and a first connecting portion disposed at one side of the second plate body. The first plate body and the second plate body are bent towards the lower plate, and the first assembly portion is locked and fastened with the first connecting portion to complete the packaging material.

8 Claims, 9 Drawing Sheets

PACKAGING MATERIAL

FIELD OF THE INVENTION

The present invention relates to a packaging material, and particularly to a packaging material that is a formed integral and is assembled and implemented through bending.

BACKGROUND OF THE INVENTION

With high division of labor and globalized development of product manufacturing, products or associated materials usually need to undergo long-distance transportation before arriving at factories or selling locations. As current products get more and more precise, many manufacturers and industrialists dispose cushioning materials around products in order to provide the products with good protection. In general, cushioning materials are fixed at corners or side surfaces of products to prevent the products from impacts and damages. However, current cushioning materials still suffer from numerous drawbacks.

For example, the Taiwan Patent Publication No. 390340 discloses "Packaging Angled Paper Formed by Pulp". The angled paper in the above disclosure is L-shaped angled paper formed from drying pulp poured into a mold. The process of drying and parching the pulp in the mold into the L-shaped angled paper requires a long waiting period. Further, the formed L-shaped angled paper is an inflexible structure having a fixed form, and cannot be stored by a flatly stacked means, such that excessive storage spaces may be occupied for storage while the transportation process of the L-shaped angled paper is also disfavored. For another example, the Taiwan Patent Publication No. 516507 discloses "Improved Cardboard Corner Protecting Structure". The above disclosure involves multiple cardboards adhered to one another to form a multilayer paper plate in advance, and the paper plates are stacked on one another to form an integral structure. An enclosing paper sheet is used to enclose the above integral multilayer structure, which is eventually pressed by a mold into an L-shaped protective angled paper structure. However, such conventional angled paper structure also needs to be pressed by a mold in order to form an L-shaped protective angled paper structure, and thus has a complex manufacturing process. Further, the formed cardboard protective angled paper structure similarly has a fixed form, and cannot be stored by a flatly stacked means, such that excessive storage spaces may be occupied for storage while the transportation process of the L-shaped angled paper is also disfavored.

It is known from above that, conventional cushioning materials commonly suffer from drawbacks of having a complex manufacturing process and occupying excessive storage spaces, hence leading to issues of storage and transportation complications that need to be solved.

SUMMARY OF THE INVENTION

The primary object of the present invention is to solve the issue of a complex manufacturing process of a conventional cushioning material.

The secondary object of the present invention is to solve transportation and storage complications caused by a fixed form of a conventional non-stackable cushioning material.

To solve the above objects, the present invention provides a packaging material as an integral formed from a cushioning material. The packaging material includes a lower plate, a first side plate and a second side plate. The lower plate includes a first side for connecting the first side plate, and a second side for connecting the second side plate, jointly defining an included angle with the first side and for connecting the second side plate. The first side plate includes a first plate body, a first bending line formed on the first plate body and for connecting the first side, and a first assembly portion disposed at one side of the first plate body near the second side plate. The second side plate includes a second plate body, a second bending line formed on the second plate body and for connecting the second side, and a first connecting portion disposed at one side of the second plate body near the first side plate. The first plate body is bent along the first bending line towards the lower plate, the second plate body is bent along the second bending line towards the lower plate, and the first assembly portion and the first connecting portion are locked and fastened to complete the packaging material.

In one embodiment, the first assembly portion is a first recess. The first connecting portion includes a first connecting piece connected to one side of the second plate body near the first side plate, a first crease formed on the first connecting piece and for connecting the second plate body, and a first tenon protruding from the first connecting piece towards a direction away from the second plate body. The first piece is bent along the first crease towards the first plate body, and the first tenon and the first recess are locked and fastened.

In one embodiment, the first connecting portion is a first recess. The first assembly portion includes a first connecting piece connected to one side of the first plate body near the second side plate, a first crease formed on the first connecting piece and for connecting the first plate body, and a first tenon protruding from the first connecting piece towards a direction away from the first plate body. The first connecting piece is bent along the first crease towards the second plate body, and the first tenon and the first recess are locked and fastened.

In one embodiment, the first side plate further includes a first reinforcement piece connected to one side of the first plate body away from the first bending line, and a first folding line for connecting the first plate body and the first reinforcement piece. One side of the first reinforcement piece away from the first folding line is a first assembly side. The second side plate further includes a second reinforcement piece connected to one side of the second plate body away from the second bending line, and a second folding line for connecting the second plate body and the second reinforcement piece. One side of the second reinforcement piece away from the second folding line is a second assembly side. After the first plate body is bent towards the lower plate, the first reinforcement piece is folded along the first folding line towards the first plate body to become overlapped on the first plate body, and further becomes secured by abutting the first assembly side against the lower plate. Further, after the second plate body is bent towards the lower plate, the second reinforcement piece is folded along the second folding line towards the second plate body to become overlapped on the second plate body, and becomes secured by abutting the second assembly side against the lower plate.

In one embodiment, the lower plate includes a third side connected to the second side and jointly defining another included angle with the second side. The packaging material further includes a third side plate connected to the third side. The third side plate includes a third plate body, a third bending line formed on the third plate body and for connecting the third side, and a second assembly portion disposed at one side of the third plate body near the second side plate. The second side plate further includes a second connecting portion disposed at one side of the second plate body near the third side plate. After the second plate body is bent towards the lower plate, the third plate body is bent along the third bending line towards the lower plate, and the second assembly portion and the second connecting portion are locked and fastened to complete the packaging material.

In one embodiment, the first assembly portion and the second assembly portion are a first recess and a second recess, respectively. The first connecting portion includes a first connecting piece connected to one side of the second plate body near the first side plate, a first crease formed on the first connecting piece and for connecting the second plate body, and a first tenon protruding from the first connecting piece towards a direction away from the second plate body. The second connecting portion includes a second connecting piece connected to one side of the second plate body near the third side plate, a second crease formed on the second connecting piece and for connecting the second plate body, and a second tenon protruding from the second connecting piece towards a direction away from the second plate body. The first connecting piece is bent along the first crease towards the first plate body, and the second connecting piece is bent along the second crease towards the third plate body. Thus, the first tenon and the first recess are locked and fastened, and the second tenon and the second recess are locked and fastened.

In one embodiment, the first connecting portion and the second connecting portion are a first recess and a second recess, respectively. The first assembly portion includes a first connecting piece connected to one side of the first plate body near the second side plate, a first crease formed on the first connecting piece and for connecting the first plate body, and a first tenon protruding from the first connecting piece towards a direction away from the first plate body. The second assembly portion includes a second connecting piece connected to one side of the third plate body near the second side plate, a second crease formed on the second connecting piece and for connecting the third plate body, and a second tenon protruding from the second connecting piece towards a direction away from the third plate body. The first connecting piece and the second connecting piece are bent along the first crease and the crease towards the second plate body, respectively. Thus, the first tenon and the first recess are locked and fastened, and the second tenon and the second recess are locked and fastened.

In one embodiment, the third side plate further includes a third reinforcement piece connected to one side of the third plate body away from the third bending line, and a third folding line for connecting the third plate body and the third reinforcement piece. One side of the third reinforcement piece away from the third folding line is a third assembly side. After the third plate body is bent towards the lower plate, the third reinforcement piece is bent along the third folding line towards the third plate body to become overlapped on the third plate body, and becomes secured by abutting the third assembly side against the lower plate.

Through the foregoing technical solutions, the present invention provides following advantages compared to the prior art.

First of all, the present invention is a planar plate-like structure when having been manufactured. When needed, the user may assemble the present invention through bending, overlapping, locking and fastening means into a three-dimensional structure to complete the implementation of the packaging material. Thus, the present invention provides features of being highly convenient for storage and transportation.

Secondly, in the present invention, by locking and fastening the assembly portions and the connecting portions, a robust connecting relationship is formed among different side plates. Thus, the present invention does not easily become disengaged after receiving impacts, and is capable of closely abutting against corners of a product to enhance structural strength and reliability.

DETAILED DESCRIPTION OF THE PREFERRED EMBODIMENTS

Figure 1:
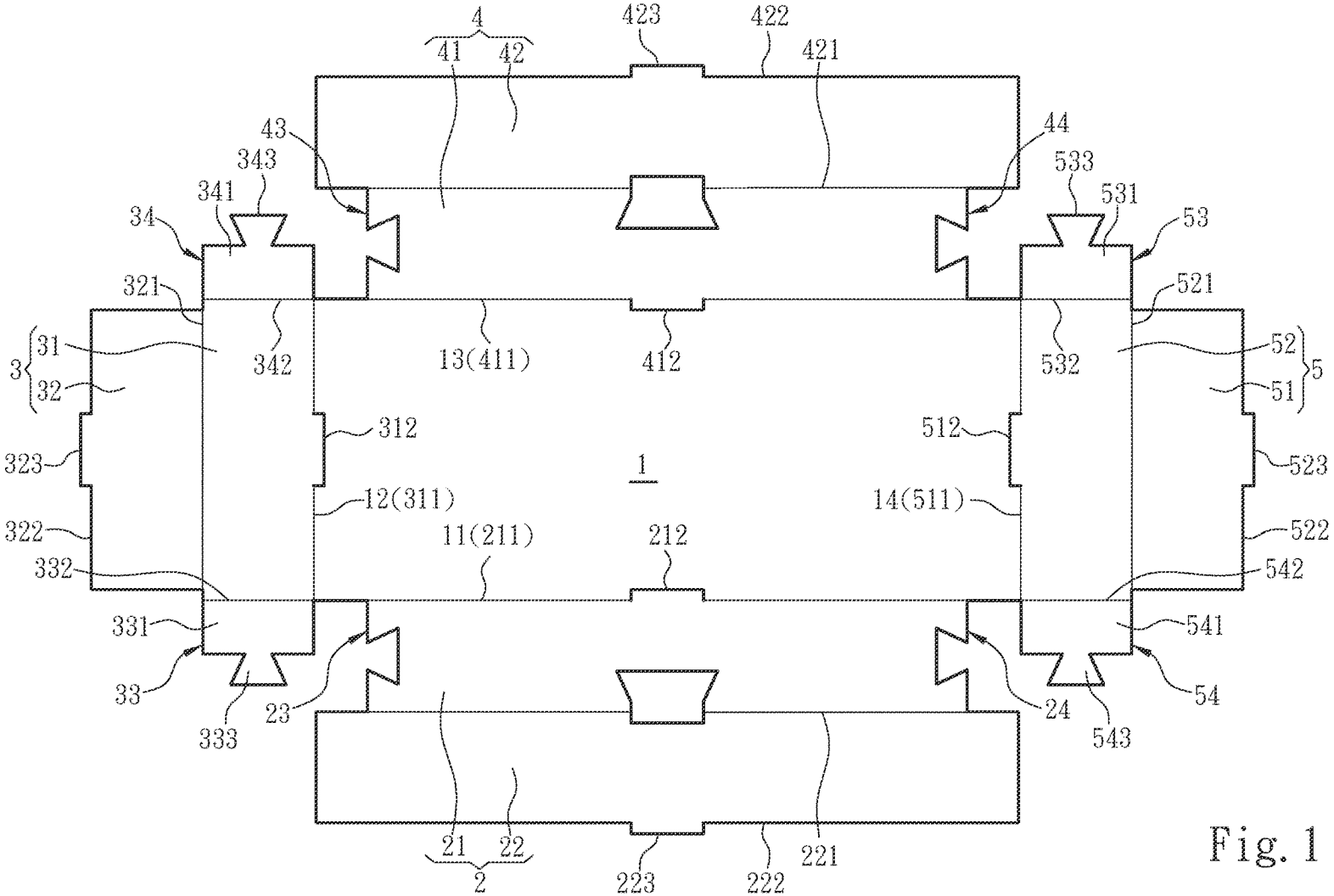
FIG. 1 is a schematic diagram of a planar structure according to a first embodiment.
Figure 2:
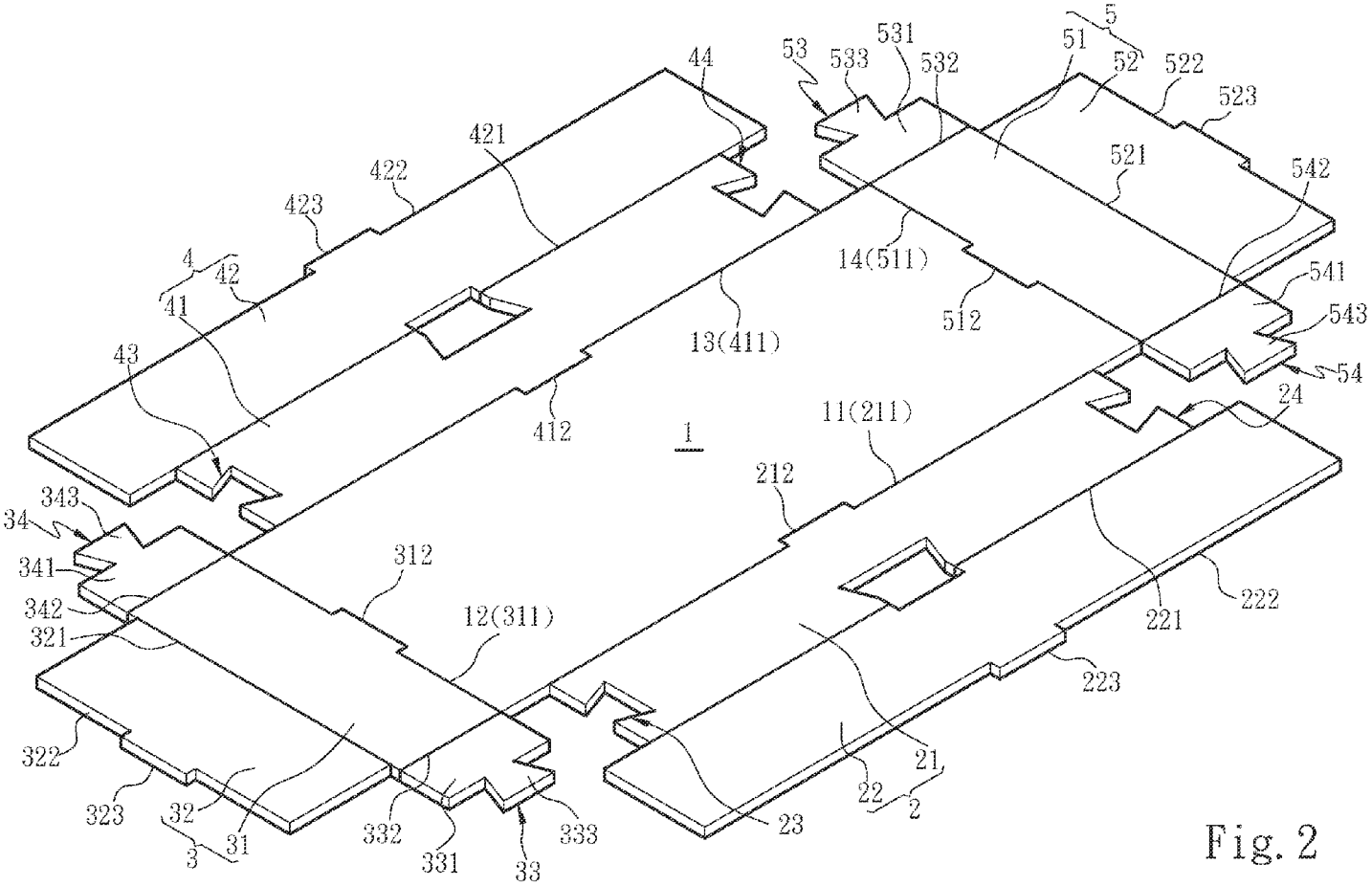
FIG. 2 is a schematic diagram of a three-dimensional structure according to the first embodiment.
Figure 3A:
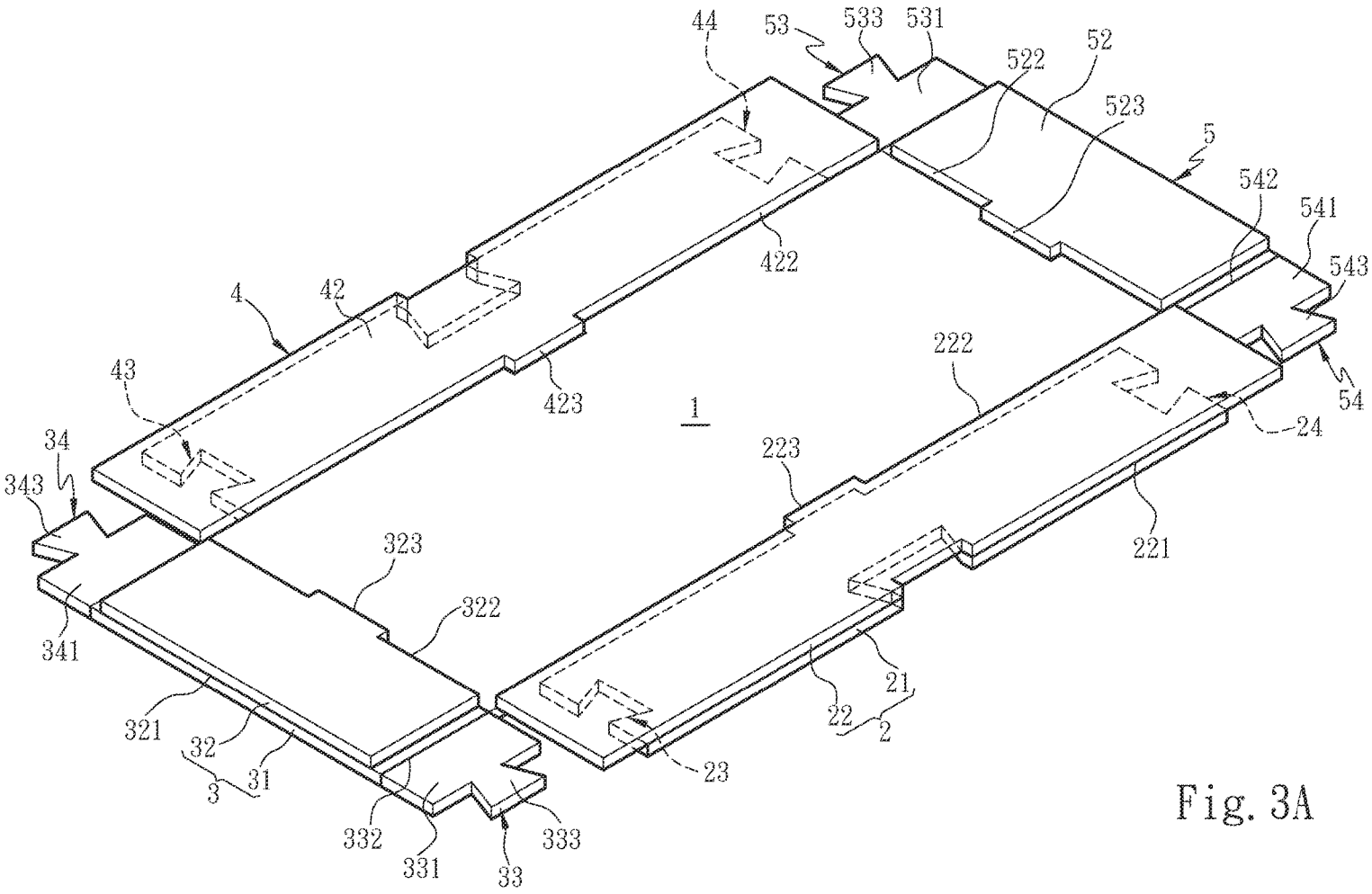
FIG. 3A to FIG. 3E are first to fifth schematic diagrams of an assembly process according to the first embodiment.
Figure 3B:
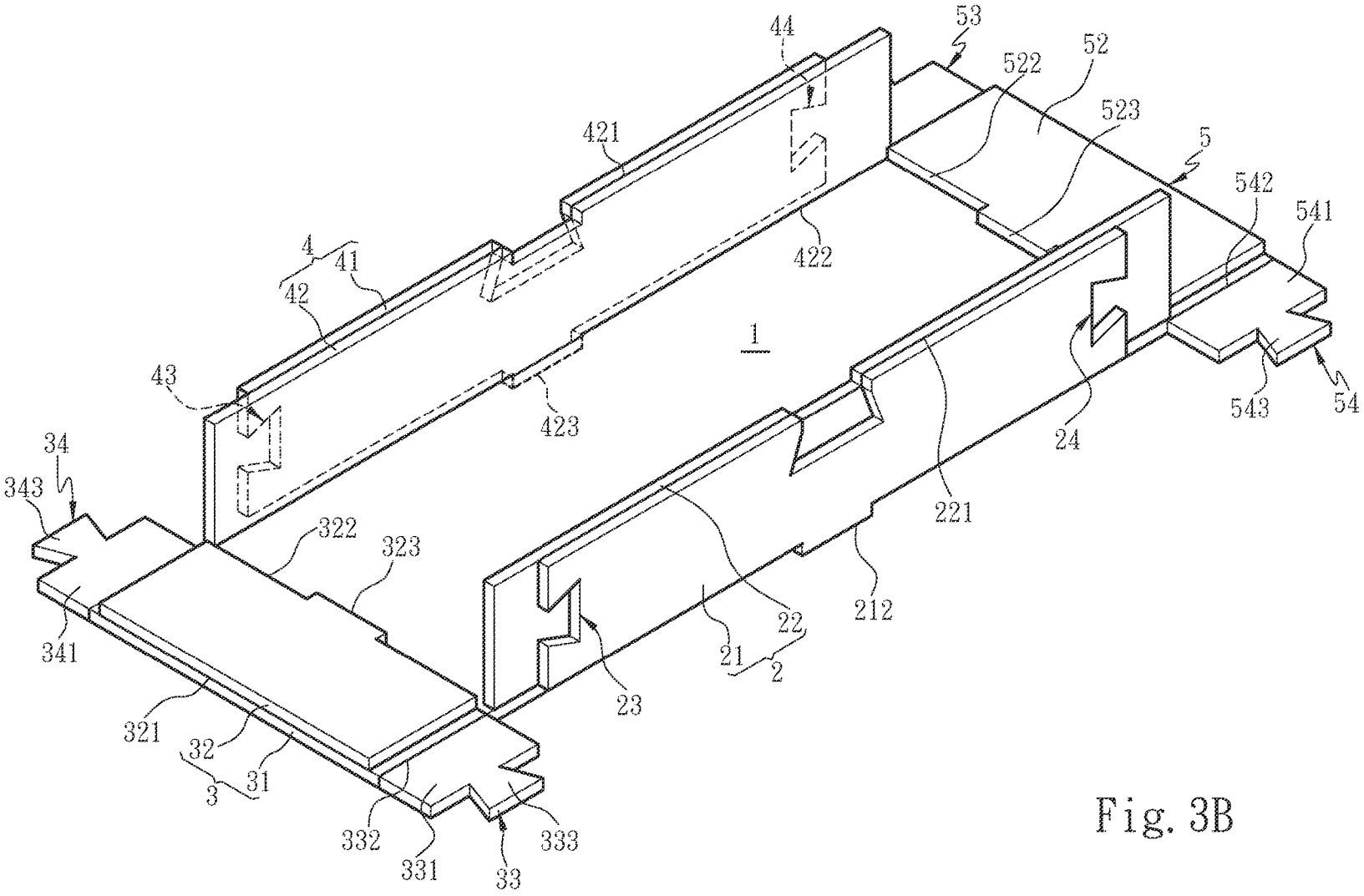
Figure 3C:
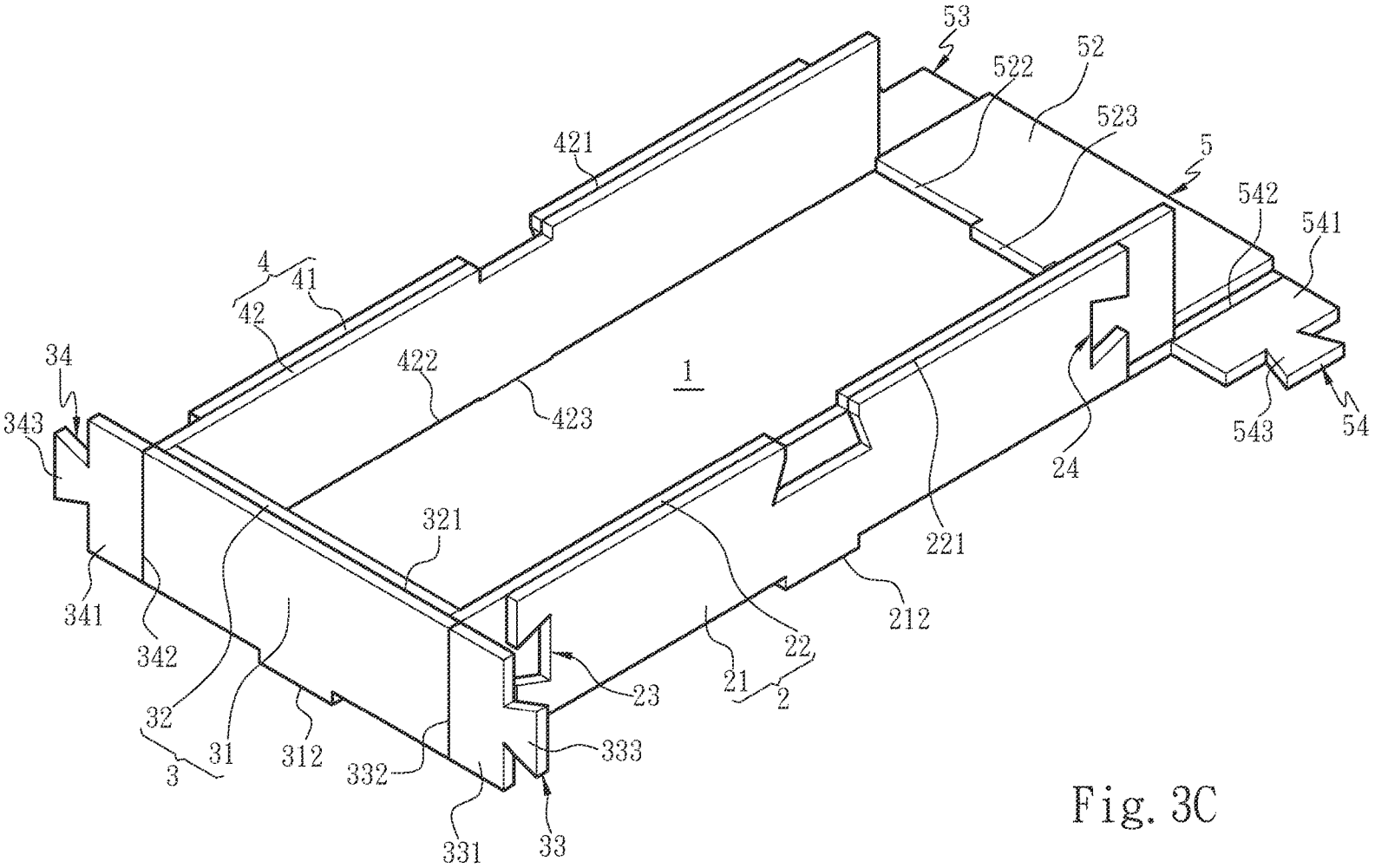
Figure 3D:
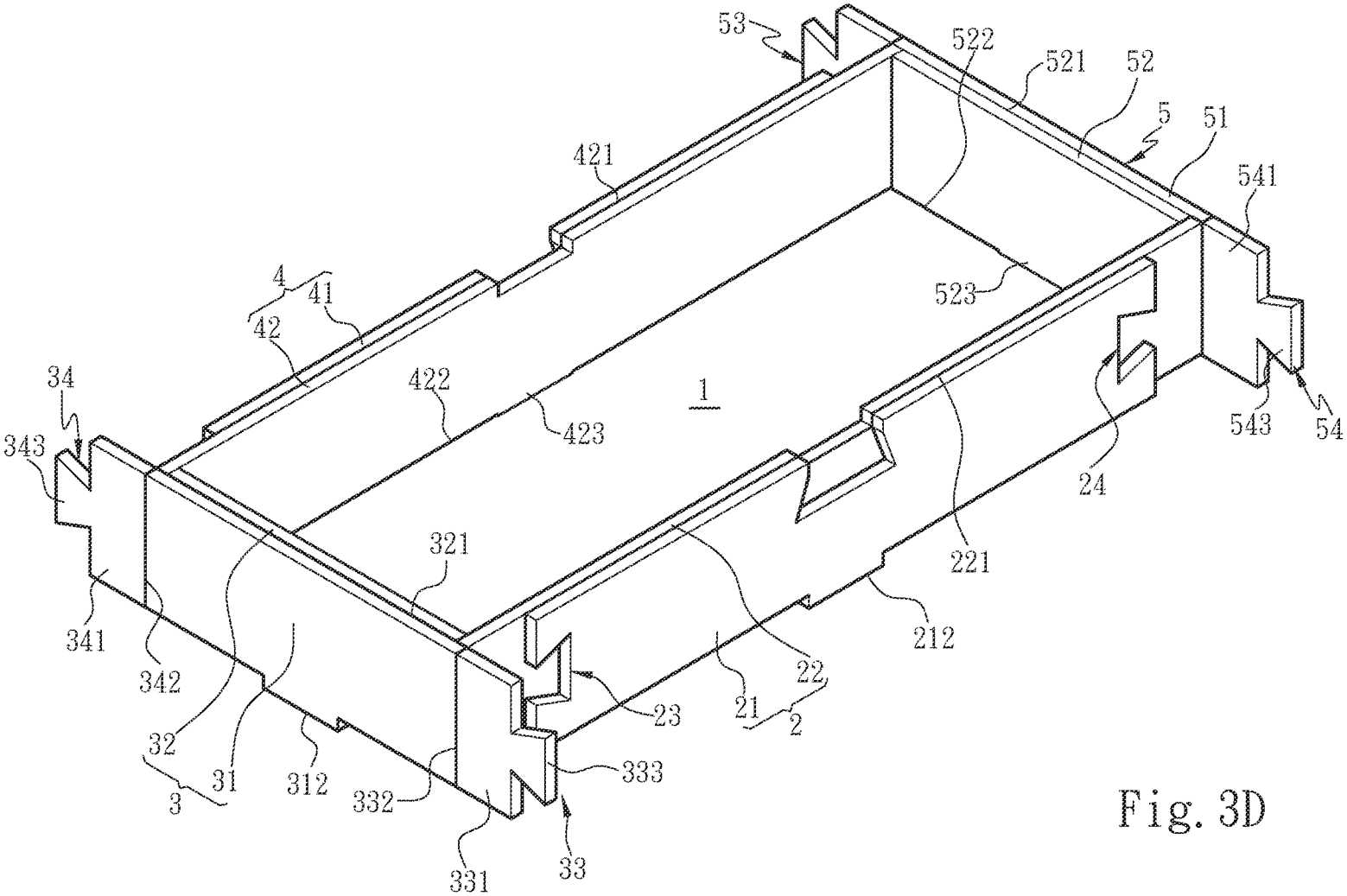
Figure 3E:
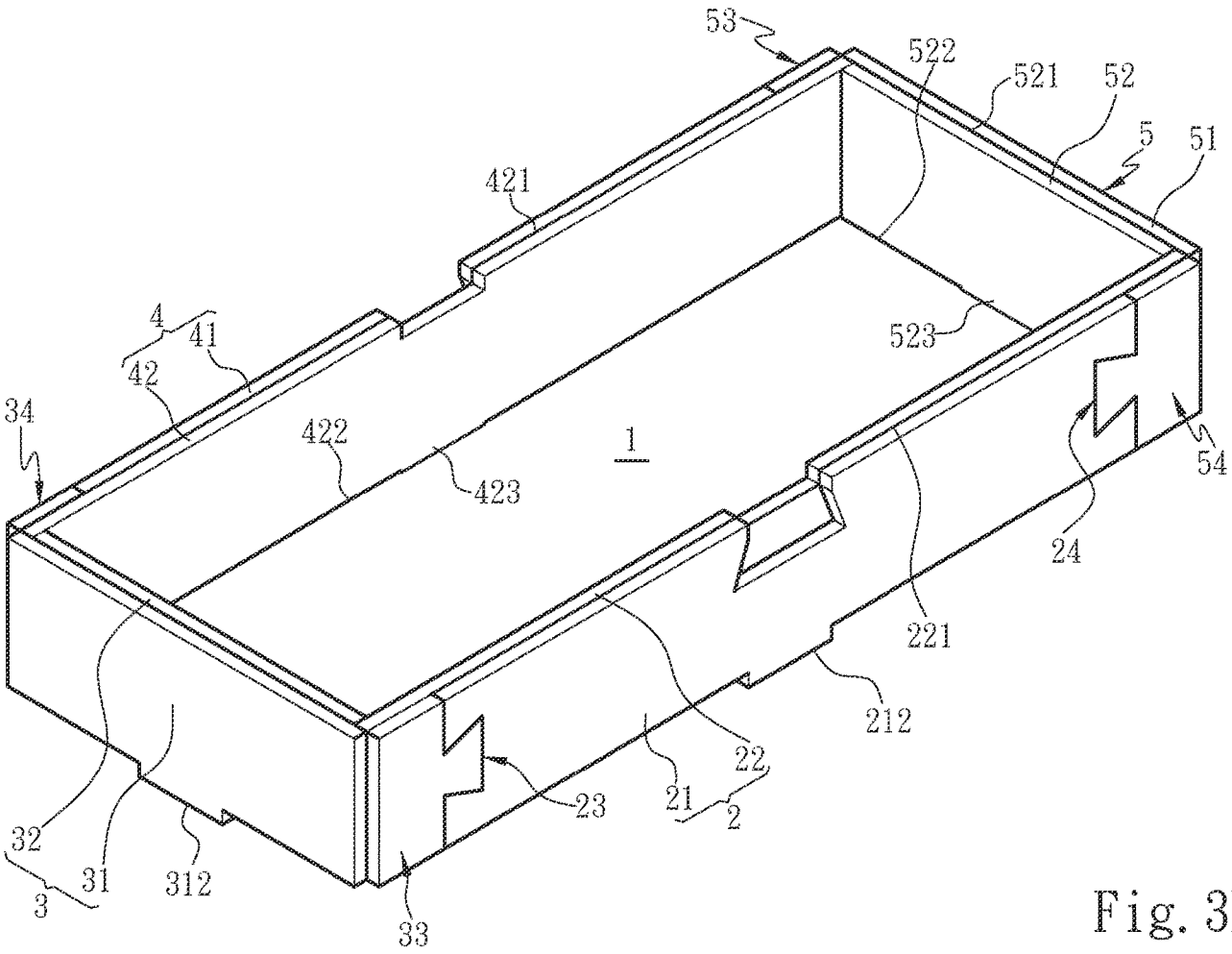

Referring to FIG. 1 and FIG. 2, the present invention provides a packaging material, which is an integral formed from a cushioning material, such as corrugated paper, a plastic material, a foam plate or other materials having appropriate strength and flexibility. In the embodiment, the packaging material includes a lower plate 1, and a first side plate 2, a second side plate 3, a third side plate 4 and a fourth side plate 5 connected to the lower plate 1. The lower plate 1 includes a first side 11, a second side 12 connected to the first side 11 and jointly defining an included angle with the first side 11, a third side 13 connected to the second side 12 and jointly defining another included angle with the second side 12, and a fourth side 14 connected to the third side 13 and the first side 11. In the embodiment, for example but not limited to, the lower plate 1 is a quadrilateral, and has a 90° included angle between any two adjacent sides. The lower plate 1 may also be a triangle, a pentagon or other polygons.

The first side plate 2, the second side plate 3, the third side plate 4 and the fourth side plate 5 are connected to the first side 11, the second side 12, the third side 13 and the fourth side 14 of the lower plate 1, respectively. The first side 2 includes a first plate body 21, a first bending line 211 formed on the first plate body 21 and for connecting the first side 11, a first reinforcement piece 22 connected to the one side of the first plate body 21 away from the first bending line 211, a first folding line 221 for connecting the first plate body 21 and the first reinforcement piece 22, and a first assembly portion 23 disposed at one side of the first plate body 21 near the second side plate 3. One side of the first reinforcement piece 22 away from the first folding line 221 is a first assembly side 222. The first assembly side 222 is provided with at least one first fastening protrusion 223 that integrally protrudes from the first reinforcement piece 22 towards a direction away from the first bending line 211. The first bending line 211 includes at least one first protruding cut section 212 cut and formed correspondingly to a position of the first fastening protrusion 223. The second side plate 3, having a similar structure as the first side plate 2, includes a second plate body 31, a second bending line 311 formed on the second plate body 31 and for connecting the second side 12, a second reinforcement piece 32 connected to one side of the second plate body 31 away from the second bending line 311, a second folding line 321 for connecting the second plate body 31 and the second reinforcement piece 32, and a first connecting portion 33 disposed at one side of the second plate body 31 near the first side plate 2. One side of the second reinforcement piece 32 away from the second folding line 321 is a second assembly side 322. The second assembly side 322 is provided with at least one second fastening protrusion 323 that integrally protrudes from the second reinforcement piece 32 towards a direction way from the second folding line 321. The second bending line 311 includes at least one second protruding cut section 312 cut and formed correspondingly to a position of the second fastening protrusion 323. The first assembly portion 23 and the second assembly portion 43 may be implemented in various different forms. In one embodiment, the first assembly portion 23 may be a first recess facing the second side plate 3. The first connecting portion 33 includes a first connecting piece 331 connected to one side of the second plate body 31 near the first side plate 2, a first crease 332 formed on the first connecting piece 331 and for connecting the second plate body 31, and a first tenon 333 protruding from the first connecting piece 331 towards a direction away from the second plate body 31 and forming a fastening relationship with the first recess.

Referring to FIG. 2 and FIG. 3A to FIG. 3E, to implement the present invention, the first reinforcement piece 22 is folded along the first folding line 221 towards the first plate body 21 to become overlapped on the first plate body 21, and the second reinforcement piece 32 is folded along the second folding line 321 towards the second plate body 31 to become overlapped on the second plate body 31. Thus, the first fastening protrusion 223 and the second fastening protrusion 323 are located above the first protruding cut section 212 and the second protruding cut section 312, respectively. The first plate body 21 is bent along the first bending line 211 towards the lower plate 1, such that the first assembly side 222 of the first reinforcement piece 22 closely abuts against the lower plate 1 to become secured. Further, the bent first protruding cut section 212 is separated from the lower plate 1 to form a space (not shown) that limits the movement of the first tenon 233 to further reinforce the fastening relationship between the first side plate 2 and the lower plate 1. On the other hand, the second plate body 31 is bent along the second bending line 311 towards the lower plate 1, such that the second assembly side 322 of the second reinforcement piece 32 closely abuts against the lower plate 1 to become secured. Further, the bent second protruding cut section 312 is separated from the lower plate 1 to form a space (not shown) that limits the movement of the second fastening protrusion 323 to further reinforce the fastening relationship between the second side plate 3 and the lower plate 1. After the first side plate 2 and the second side plate 3 are both bent towards the lower plate 1, the first connecting piece 331 of the second plate body 31 is bent along the first crease 332 towards the first side plate 2 until the first connecting piece 331 and the first plate body 21 become co-planar. As such, the first tenon 333 is locked and fastened in the first assembly portion 23 (i.e., the first groove) to allow the first side plate 2 and the second side plate 3 to form a firm fastening relationship. At this point, the packaging material may be installed at a corner position of an object to be protected and serve as a protective cushioning angled material.

The position of the third side plate 4 corresponds to the position of the first side plate 2, and has a structure similar to that of the first side plate 2. The third side plate 4 includes a third plate body 41, a third bending line 411 formed on the third plate body 41 and for connecting the third side 13, a third reinforcement piece 42 connected to one side of the third plate body 41 away from the third bending line 411, a third folding line 421 for connecting the third plate body 41 and the third reinforcement piece 42, and a second assembly portion 43 disposed at one side of the third plate body 41 near the second side plate 3. Further, one side of the third reinforcement piece 42 away from the third folding line 421 is a third assembly side 422. The third assembly side 422 is provided with at least one third fastening protrusion 423 that integrally protrudes from the third reinforcement piece 42 towards a direction away from the third folding line 421. The third bending line 411 includes at least one third protruding cut section 412 cut and formed correspondingly to the position of the third fastening protrusion 423. The second side plate 3 further includes a second connecting portion 34 disposed at one side of the second plate body 31 near the third side plate 4, and locks and fastens with the second assembly portion 43 of the third side plate 4 through the second connecting portion 34. More specifically, the second assembly portion 43 is a second recess facing the second side plate 3. The second connecting portion 34 includes a second connecting piece 341 connected to one side of the second plate body 31 near the third side plate 4, a second crease 342 formed on the second connecting piece 341 and for connecting the second plate body 31, and a second tenon 343 protruding from the second connecting piece 341 towards a direction away from the second plate body 31 and forming a fastening relationship with the second groove.

Referring to FIG. 3A to FIG. 3E, to further assemble the present invention, the third reinforcement piece 42 is folded along the third folding line 421 towards the third plate body 41 to become overlapped on the third plate body 41, such that the third fastening protrusion 423 is located above the third protruding cut section 412. The third plate body 41 is bent along the third bending line 411 towards the lower plate 1, such that the third assembly side 422 of the third reinforcement piece 42 closely abuts against the lower plate 1. Further, the third protruding cut section 412 is separated from the lower plate 1 to form a space (not shown) that limits the movement of the third fastening protrusion 423, hence forming a firm fastening relationship between the third side plate 4 and the lower plate 1. After the second side plate 3 is bent towards the lower plate 1 and secured, the second connecting piece 341 is bent along the second crease 342 towards the third side plate 4 until the second connecting piece 341 and the second plate body 31 become co-planar. As such, the second tenon 343 is locked and fastened in the second groove (i.e., the second assembly portion 43) to allow the second side plate 3 and the third side plate 4 to form a secure assembly relationship.

The fourth side plate 5 is a structure corresponding and similar to that of the second side plate 3. The fourth side plate 5 includes a fourth plate body 51, a fourth bending line 511 formed on the fourth plate body 51 and for connecting the fourth side 14, a fourth reinforcement piece 52 connected to one side of the fourth plate body 51 away from the fourth bending line 511, and a fourth folding line 521 for connecting the fourth plate body 51 and the fourth reinforcement piece 52. One side of the fourth reinforcement piece 52 away from the fourth folding line 521 is a fourth assembly side 522. The fourth assembly side 522 is provided with at least one fourth fastening protrusion 523 that integrally protrudes from the fourth reinforcement piece 52 towards a direction away from the fourth folding line 521. The fourth bending line 511 includes at least one fourth protruding cut section 512 cut and formed correspondingly to a position of the fourth fastening protrusion 523. One side of the third plate body 41 near the fourth side plate 5 is provided with a third assembly portion 44, and one side of the first plate body 21 near the fourth side plate 5 is provided with a fourth assembly portion 14. Two opposite sides of the fourth plate body 51 near the third plate body 41 and the first plate body 21 are provided with a third connecting portion 53 and a fourth connecting portion 54, respectively. In the embodiment, the third assembly portion 44 and the fourth assembly portion 14 are a third recess and a fourth recess, respectively. The third connecting portion 53 includes a third connecting piece 531, a third crease 532 for connecting the fourth plate body 51 and the third connecting piece 531, and a third tenon 533 protruding away from the fourth plate body 51 and forming a fastening relationship with the third recess. The fourth connecting portion 54 includes a fourth connecting piece 541, a fourth crease 542 for connecting the fourth plate body 51 and the fourth connecting piece 541, and a fourth tenon 543 protruding away from the fourth plate body 51 and forming a fastening relationship with the fourth recess.

To complete the packaging material of the present invention, the fourth reinforcement piece 52 is folded along the fourth folding line 521 towards the fourth plate body 51 to become overlapped on the fourth plate body 51, and the fourth plate body 51 is bent along the fourth bending line 511 towards the lower plate 1, such that the fourth assembly side 522 closely abuts against the lower plate 1. Further, the fourth protruding cut section 512 is separated from the lower plate 1 to form a space (not shown) that limits the movement of the fourth fastening protrusion 523, hence forming a firm fastening relationship between the fourth side plate 5 and the lower plate 1. After the first side plat 2 and the third side plate 4 are bent towards the lower plate 1 and secured, the third connecting piece 531 is bent along the third crease 532 towards the third side plate 4 until the third connecting piece 531 and the third plate body 41 become co-planar. The fourth connecting piece 541 is bent along the fourth crease 542 towards the first side plate 2 until the fourth connecting piece 541 and the first side body 21 become co-planar. As such, the third tenon 533 and the fourth tenon 543 are locked and fastened in the third recess (i.e., the third assembly portion 44) and the fourth recess (i.e., the fourth assembly portion 24) to securely connect the fourth side plate 5 to the first side plate 2 and the third side plate 4, thereby completing the implementation of the packaging material according to the first embodiment of the present invention. At this point, the first side plate 2, the second side plate 3, the third side plate 4 and the fourth side plate 5 connected to one another surround and define an accommodating space, in which the product can be placed to provide a thorough protection effect around the product.

Figure 4:
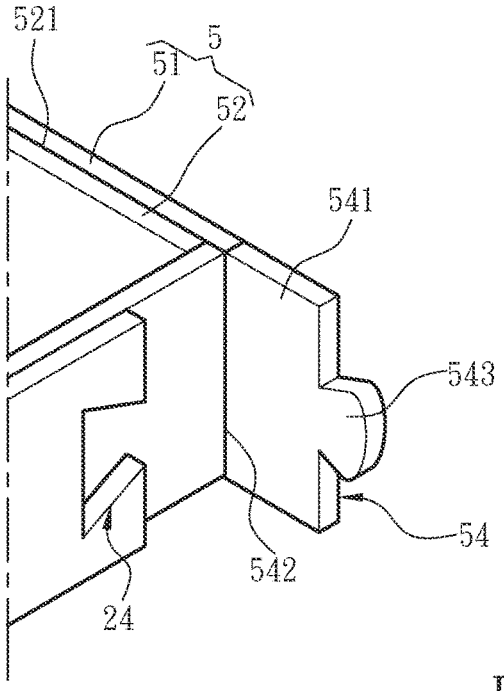
FIG. 4 is a schematic diagram of partial implementation according to a second embodiment.

It should be noted that, the assembly portions 23, 24, 43 and 44 and the connecting portions 33, 34, 53 and 54 in the first embodiment of the present invention have conforming patterns. Taking FIG. 3E for example, the so-called confirming pattern means that the first recess and the first tenon 333 have mutually corresponding shapes and can be matched with each other. For example, the first recess is a dovetail recess, and the shape of the first tenon 333 is a corresponding dovetail tenon. However, the shape is not limited to a dovetail. Further, the assembly portion 23, 24, 43 and 44 and the connecting portions 33, 34, 53 and 54 may have different patterns. Referring to FIG. 4 showing a partial schematic diagram according to a second embodiment of the present invention, the fourth assembly portion 24 (i.e., the fourth recess) is implemented by a dovetail groove, with however the fourth tenon 543 being implemented in a pattern of an arched tenon. As such, slight deformation is formed when the fourth tenon 543 is locked and fastened in the fourth recess, in a way that intervention is formed by the flexible restoring force of the fourth tenon 543 abutting against an inner periphery of the fourth recess. Thus, the fourth assembly portion 24 and the fourth connecting portion 54 are allowed to firmly assembled with each other. Similarly, the first assembly portion 23 and the first connecting portion 33, the second assembly portion 43 and the second connecting portion 34, and the third assembly portion 44 and the third connecting portion 53, may also have different patterns.

Figure 5:
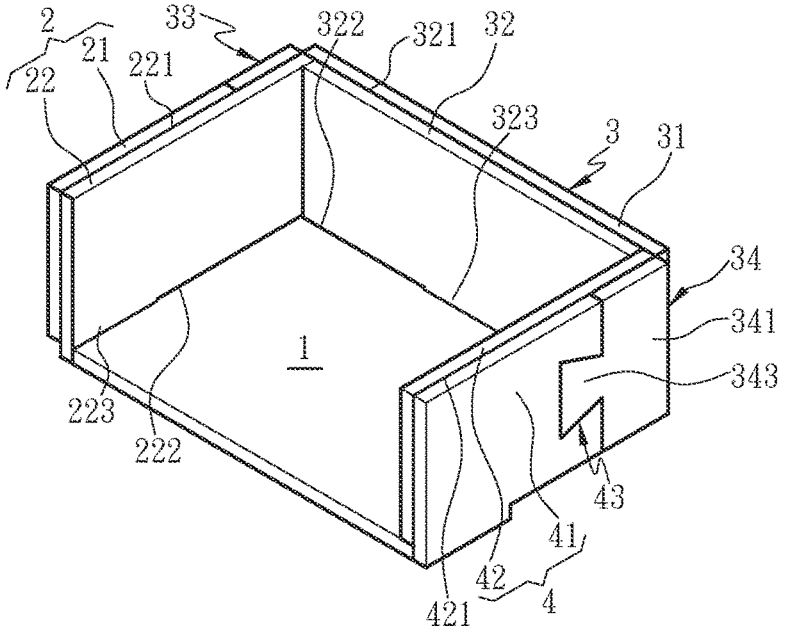
FIG. 5 is an implementation schematic diagram according to a third embodiment.

Referring to FIG. 5 showing a third embodiment of the present invention, the structure of the packaging material of this embodiment is fundamentally identical to that of the first embodiment, with however the structure of the fourth side plate 5 being omitted. Thus, the packaging material of the third embodiment is a dustpan-shaped pattern formed by the lower plate 1, the first side plate 2, the second side plate 3 and the fourth side plate 5. With the packaging material of such pattern, corners and edges of the product can be encircled to protect ends of the product.

Figure 6:
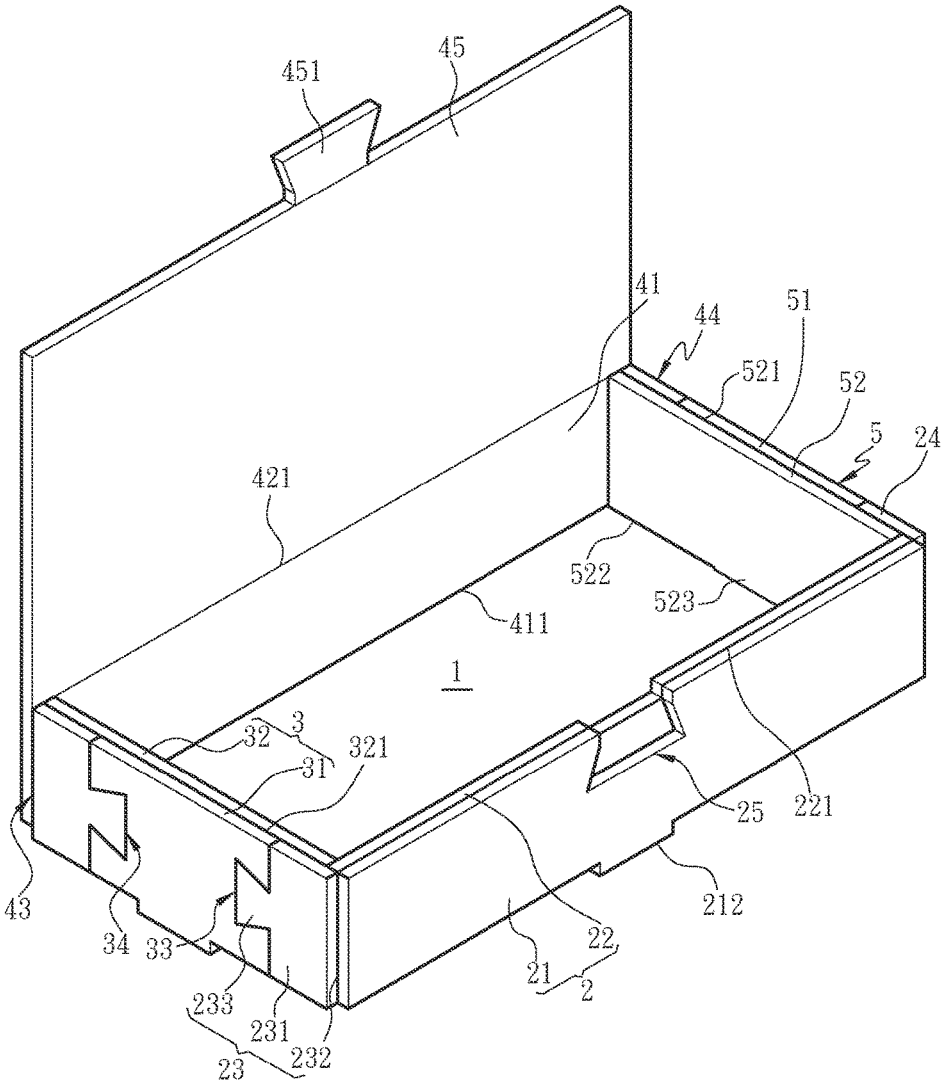
FIG. 6 is an implementation schematic diagram according to a fourth embodiment.

Referring to FIG. 6 showing a fourth embodiment of the present invention, the structure of the packaging material of this embodiment is fundamentally identical to that of the first embodiment, with however the third side plate 4 further including an upper plate 45 that replaces the third reinforcement piece 42. The upper plate 45 is connected to one side of the third plate body 41 away from the third bending line 411 through the third folding line 421, and includes a fifth tenon 451 disposed at one side of the upper plate 45 away from the third plate body 41. One side of the first plate body 21 connected to the first reinforcement piece 22 is provided with a fifth recess 25 corresponding to a position of the fifth tenon 451. In an application process, the first side plate 2, the second side plate 3, the third side plate 4 and the fourth side plate 5 are bent towards the lower plate 1 and secured, the upper plate 45 is folded along the third folding line 421 towards the first side plate 2 to become abutted on the first side plate 2, the second side plate 3 and the fourth side plate 5, and the fifth tenon 451 is bent towards the first plate body 21 to become locked and fastened in the fifth recess 25 to complete the assembly. With the bending of the upper plate 45, the packaging material forms a box-like structure that limits and encloses the product in the accommodating space to provide the product with all-round protection.

In the fourth embodiment, the assembly portions 23, 24, 43 and 44 and the connecting portions 33, 34, 53 and 54 have structures opposite those in the first embodiment. Taking the first assembly portion 23 and the first connecting portion 33 for example, the first assembly portion 23 includes a first connecting piece 231 connected to the first plate body 21, a first crease 232 for connecting the first plate body 21 and the first connecting piece 231, and a first tenon 233 protruding from the first connecting piece 231 towards a direction away from the first plate body 21. The first connecting portion 33 is a first recess, which corresponds to the first tenon 233 and forms a fastening relationship with the first assembly tenon 233. That is, the patterns of the first assembly portion 23 and the first connecting portion 33 in the first embodiment are swapped in this embodiment. Similarly, the second assembly portion 43 and the second connecting portion 34, the third assembly portion 44 and the third connecting portion 53, and the fourth assembly portion 24 and the fourth connecting portion 54, also have patterned that are swapped from the patterns disclosed in the first embodiment.

What is claimed is:

1. A packaging material, being an integral formed from a cushioning material, the packaging material comprising:

a lower plate, comprising a first side, and a second side connected to the first side and jointly defining an included angle with the first side; and a first side plate and a second side plate respectively connected to the first side and the second side, the first side plate comprising a first plate body, a first bending line, and a first assembly portion, the second side plate comprising a second plate body, a second bending line, and a first connecting portion; wherein the first bending line is forming on the first plate body and for connecting the first side, the first assembly portion is disposed at one side of the first plate body near the second side plate, the second bending line is formed on the second plate body and for connecting the second side, and the first connecting portion is disposed at one side of the second plate body near the first side plate;

wherein, the first side plate defines a long side which is adjacent to the lower plate, a length of the long side is shorter than a length of the first side, the first connecting portion has a first distance extended from the second side plate to the first side plate, the first plate body has a second distance dented away from the first connecting portion, the first distance is equal to the second distance, the first plate body is bent along the first bending line towards the lower plate, and the second plate body is bent along the second bending line towards the lower plate, such that the first assembly portion and the first connecting portion become locked and fastened.

2. The packaging material of claim 1, wherein the first assembly portion is a first recess; the first connecting portion comprises a first connecting piece at one side of the second plate body near the first side plate, a first crease formed on the first connecting piece and for connecting the second plate body, and a first tenon protruding from the first connecting piece towards a direction away from the second plate body; wherein, the first connecting piece is bent along the first crease towards the first plate body, such that the first tenon and the first recess become locked and fastened.

3. The packaging material of claim 1, wherein the first connecting portion is a first recess; the first assembly portion comprises a first connecting piece connected to one side of the first plate body near the second side plate, a first crease formed on the first connecting piece and for connecting the first plate body, and a first tenon protruding from the first connecting piece towards a direction away from the first plate body; and the first tenon and the first recess are locked and fastened.

4. The packaging material of claim 1, wherein the first side plate further comprises a first reinforcement piece connected to one side of the first plate body away from the first bending line, and a first folding line for connecting the first plate body and the first reinforcement piece; one side of the first reinforcement piece away from the first folding line is a first assembly side; the second side plate further comprises a second reinforcement piece connected to one side of the second plate body away from the second bending line, and a second folding line connecting the second plate body and the second reinforcement piece; one side of the second reinforcement piece away from the second folding line is a second assembly side; the first plate body is bent towards the lower plate, the first reinforcement piece is folded along the first folding line towards the first plate body to become overlapped on the first plate body, such that the first assembly side abuts against the lower plate; the second plate body is bent towards the lower plate, and the second reinforcement piece is folded along the second folding line towards the second plate body to become overlapped on the second plate body, such that the second assembly side abuts against the lower plate.

5. The packaging material of claim 1, wherein the lower plate comprises a third side connected to the second side and jointly defining another included angle with the second side; the packaging material further comprises a third side plate connected to the third side; the third side plate comprises a third plate body, a third bending line formed on the third plate body and for connecting the third side, and a second assembly portion disposed at one side of the third plate body near the second side plate; the second side plate further comprises a second connecting portion disposed at one side of the second plate body near the third side plate; the third plate body is bent along the third bending line towards the lower plate, such that the second assembly portion and the second connecting portion are locked and fastened.

6. The packaging material of claim 5, wherein the first assembly portion and the second assembly portion are a first recess and a second recess, respectively; the first connecting portion comprises a first connecting piece connected to one side of the second plate body near the first side plate, a first crease formed on the first connecting piece and for connecting the second plate body, and a first tenon protruding from the first connecting piece towards a direction away from the second plate body; the second connecting portion comprises a second connecting piece connected to one side of the second plate body near the third side plate, a second crease formed on the second connecting piece and for connecting the second plate body, and a second tenon protruding from the second connecting piece towards a direction away from the second plate body; the first connecting piece is bent along the first crease towards the first plate body, and the second connecting piece is bent along the second crease towards the third plate body, such that the first tenon and the first recess become locked and fastened, and the second tenon and the second recess become locked and fastened.

7. The packaging material of claim 5, wherein the first connecting portion and the second connecting portion are a first recess and a second recess, respectively; the first assembly portion comprises a first connecting piece connected to one side of the first plate body near the second side plate, a first crease formed on the first connecting piece and for connecting the first plate body, and a first tenon protruding from the first connecting piece towards a direction away from the first plate body; the second assembly portion comprises a second connecting piece connected to one side of the third plate body near the second side plate, a second crease formed on the second connecting piece and for connecting the third plate body, and a second tenon protruding from the second connecting piece towards a direction away from the third plate body; the first connecting piece and the second connecting piece are bent along the first crease and the second crease towards the second plate body, respectively, such that the first tenon and the first recess are locked and fastened, and the second tenon and the second recess are locked and fastened.

8. The packaging material of claim 5, wherein the third side plate further comprises a third reinforcement piece connected to one side of the third plate body away from the third bending line, and a third folding line connected to the third plate body and the third reinforcement piece; one side of the third reinforcement piece away from the third folding line is a third assembly side; the third plate body is bent towards the lower plate, and the third reinforcement piece is folded along the third folding line towards the third plate body to become overlapped on the third plate body, such that the third assembly side abuts against the lower plate and becomes secured.

* * * * *